United States Patent [19]

LaBarge et al.

[11] Patent Number: 4,783,985

[45] Date of Patent: Nov. 15, 1988

[54] INTEGRAL RIVET AND METHOD OF MAKING

[75] Inventors: Robert L. LaBarge, Ben Avon Borough; Frank E. Maier, Lower Burrell, both of Pa.

[73] Assignee: Aluminum Company of America, Pittsburgh, Pa.

[21] Appl. No.: 23,668

[22] Filed: Mar. 9, 1987

Related U.S. Application Data

[60] Division of Ser. No. 847,772, Apr. 3, 1986, Pat. No. 4,678,096, which is a continuation-in-part of Ser. No. 738,975, May 29, 1985, abandoned.

[51] Int. Cl.[4] ..... B21C 37/02

[52] U.S. Cl. ..... 72/379; 413/8; 29/509; 29/522.1

[58] Field of Search ..... 413/8, 14, 56, 62, 66; 29/509, 522 R; 72/379

[56] References Cited

U.S. PATENT DOCUMENTS

| | | | |
|---|---|---|---|
| 3,191,564 | 6/1965 | Fraze | 413/14 |
| 3,440,713 | 4/1969 | Henchert | 29/509 |
| 3,479,733 | 11/1969 | Brown | 29/509 |
| 3,638,597 | 2/1972 | Brown | 29/509 |
| 4,533,064 | 8/1985 | Kawamata et al. | 220/273 |
| 4,580,692 | 4/1986 | LaBarge et al. | 220/269 |

*Primary Examiner*—Frederick R. Schmidt
*Assistant Examiner*—Robert Showalter
*Attorney, Agent, or Firm*—Max L. Williamson; David W. Brownlee

[57] ABSTRACT

A method of forming an integral rivet in a sheet metal panel by successively coining portions circumscribing a central portion thereof so that the end panel stock is not stretched and a long shanked rivet is produced. The rivet has a relatively thin wall shank and a relatively thick crown which provides sufficient metal for stacking into a rivet head having a wide formable flange.

11 Claims, 6 Drawing Sheets

INTEGRAL RIVET AND METHOD OF MAKING

This application is a division of application Ser. No. 847,772, filed Apr. 3, 1986, now U.S. Pat. No. 4,678,096, which is a continuation-in-part of Ser. No. 738,975, filed May 29, 1985, now U.S. Pat. No. 4,580,692.

BACKGROUND OF THE INVENTION

This invention relates to a method of forming an integral sheet metal rivet.

Integral rivets have long been known to attach objects of various kinds to metal panels. In recent times, one of the most widely used applications for an integral rivet has been to attach opening levers or tabs to the scored ends of beverage cans. One of the earliest patents directed to a method for forming a rivet for such an application is Fraze U.S. Pat. No. 3,191,564. In the first step of Fraze's method, a bubble having an area in plan substantially greater than area in plan of the desired rivet is formed by stretching the sheet without making any substantial reduction in thickness. The bubble is then reshaped into a rivet having a hat-shaped configuration with the transverse wall of the hat section made substantially thicker during reshaping and the rivet having a much smaller area in plan. A tab or lever is then attached to the can by staking the rivet. In staking the rivet, it is positioned on an anvil support and the transverse wall is impacted with an opposing anvil or hammer to extrude metal radially outwardly to form a flange which holds the tab against the can end.

Brown U.S. Pat. No. 3,479,733 describes a rivet forming method whereby the can end is supported on a flat die and impacted with an opposing die having an opening therein. The opposing die has an annular portion projecting outwardly from its face around the opening so that when it impacts the end metal, metal is squeezed inwardly to form a bubble. To attach a tab, the tab is positioned over the bubble and the bubble is simply mashed or compressed downwardly to form a flange which impinges against the tab and holds it in place on the can end.

Brown U.S. Pat. No. 3,638,597 describes yet another method for forming a rivet. An initial dimple or bubble is formed by a combination of stretching and squeezing the metal. The sheet to be formed is placed over a die cavity and contacted with a punch which stretches the sheet into the cavity. As the punch nears the end of its stroke, metal between the punch and walls of the die cavity is squeezed and extruded radially into the cavity to thicken the crown portion of the dimple which is later staked to form the flange.

The foregoing are examples of many patents which discuss forming integral rivets to attach devices to can ends. Each of the described rivets is suggested for use in rigidly attaching relatively thin metal objects to can ends. The shanks of these rivets are all relatively short, therefore, to accommodate the thin metal. Furthermore, there is no need for the rivet head to have more than a relatively narrow outwardly extending flange since the object is rigidly attached and is held in place by the rivet shank tightly filling the opening in the object as well as the outwardly extending flange covering the object adjacent the opening. The high modulus of elasticity of the metal object provides a high resistance to enlargement of the rivet hole in it and a narrow flange, therefore, provides a secure attachment. Although the known rivets and methods for making them have been suitable for attaching thin metal objects, such as tabs to can ends, the attachment of at least some other kinds of objects presents a totally different set of problems and conditions. For example, parent application Ser. No. 738,975, filed May 29, 1985, discusses rotatably attaching a plastic cap to a can end. It is approximately twice as thick as the typical metal tab presently being attached to can ends with integral rivets; thus, the rivet requires a shank twice as long. Furthermore, the plastic cap is rotatable about the rivet shank. The rivet must be capable of being staked to form the head, therefore, without expanding the shank or impinging the head against the cap so tightly that it cannot be rotated. Since attachment of the cap is solely dependent upon the flange overlying the cap around the opening and plastic is readily deformable because its modulus of elasticity is approximately 1/500 that of a typical aluminum tab, it would be desirable to extend the rivet flange outwardly from the shank significantly further than rivets known heretofore. Because the rivet hole in the cap has a very low resistance against enlargement, it is also desirable to bend the flange downward to interlock the cap with the rivet. By bending the flange downward, a cap retaining cavity underlying the flange can be formed which has at least a portion having a dimension parallel to the rivet shank greater than the dimension at the entrance to the cavity. Thus, if the cap is designed to have a portion which substantially fills such a cavity, the cap cannot be disassembled without subjecting the plastic to a large percentage compressive deformation. For all of the foregoing reasons, it would be desirable to have an improved rivet and method of making it, particularly for attaching a deformable plastic object to a can end.

SUMMARY OF THE INVENTION

Forming a rivet by a method of this invention enables making a long shank rivet having a relatively large-diameter, formable head from a portion of a metal panel having a minimal plan area. All of the metal required to form the rivet is gathered from such a panel area by coining. In a first coining step, metal is extruded inwardly and outwardly from a coined ring in the panel. The panel wall within the ring is not restrained during coining, and the inwardly extruded metal added to the unrestrained interior panel wall causes a bubble to be formed having substantially the same thickness as the panel before coining. The panel outward of the ring is partially restrained from movement so that the outwardly extruded metal adds to the original panel wall causing it to buckle into a ridge having substantially the same thickness as the panel before coining. In a second step, the first formed portion having the bubble, the coined ring and the ridge therein is reformed to partially form the rivet and increase the height of the central bubble portion. Then a portion of the ridge is coined to recapture a portion of the metal which had been extruded outwardly by extruding metal inwardly and gathering it in a thickened portion circumscribing the shank of the partially formed rivet. In a final coining step before staking to form the head, the metal which was extruded inwardly and recaptured in the previous step is coined to extrude the metal inwardly to lengthen the shank. In its finished form before staking, the rivet has an end wall having a thickness substantially the same as the unformed panel and having a central bubble portion connected to the shank by an outwardly arcuate portion. An object to be attached to the panel can then be placed over the shank and the rivet staked by coining the end wall and extruding metal outwardly to form a flange. Preferably, the rivet end wall is reformed before staking to have a substantially smooth dome shape.

A rivet of this invention has a relatively long shank with the head having a relatively wide flange extending outwardly therefrom. It is particularly suited for use in attaching an object to the panel which is to be rotated about the rivet. It is especially advantageous if the object is made from a material having a low modulus of elasticity, such as plastic, for example, because the flange of a rivet of this invention can be bent downward to engage the object in an interlock in a manner which requires the material to be squeezed and stretched in order to disengage the object from the rivet.

In another aspect of the invention, an annular upwardly projecting ridge is formed outwardly of the rivet shank to provide a recess to accommodate a portion of a device and further discourages detachment of the device from the can end.

It is an objective of this invention to provide a method for forming a long shank integral rivet in a can end which is capable of being staked to provide a wide formable flange.

It is also an objective of this invention to provide a method of making a rivet for securing a device to a metal panel in a manner which permits rotation of the device about the rivet shank.

These and other objectives of this invention may be more readily understood from the following detailed description and accompanying drawings. cl BRIEF DESCRIPTION OF THE DRAWINGS FIG. 1 is a plan view of a can end having a rotatable plastic cap attached thereto with an integral rivet made by a method of this invention.

Figure 5:
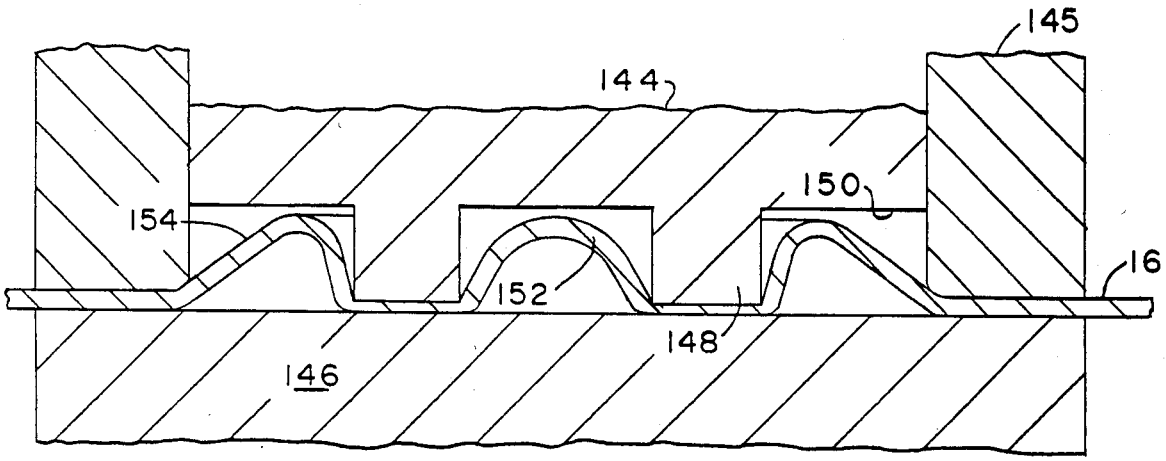
FIG. 5 is a cross-sectional view of a portion of a can end and forming dies at the completion of a first forming step to form a bubble and an upstanding annular ridge in the can end in making an integral rivet by a method of this invention.
Figure 6:
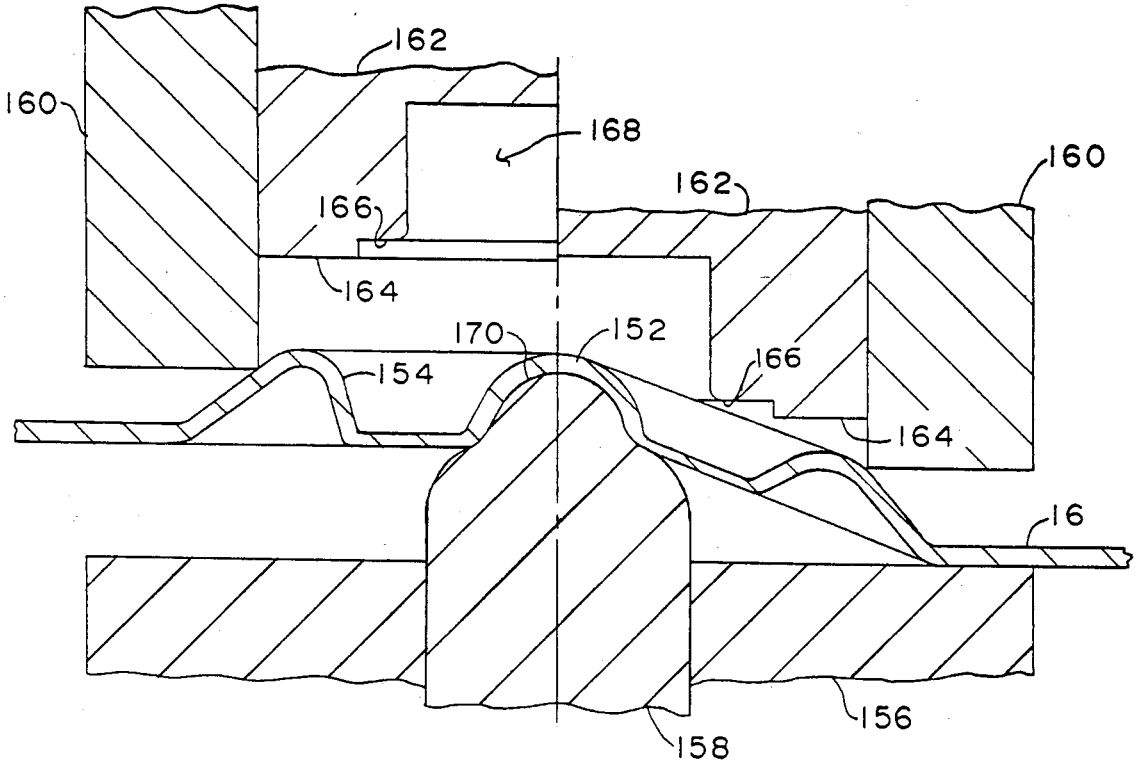

FIG. 6 to the left of the centerline is a cross-sectional view of the can end portion shown in FIG. 5 and forming dies at the beginning of a second forming step to make a partially formed rivet, and to the right of the centerline is a cross-sectional view of the can end and dies at an intermediate stage.

Figure 7:
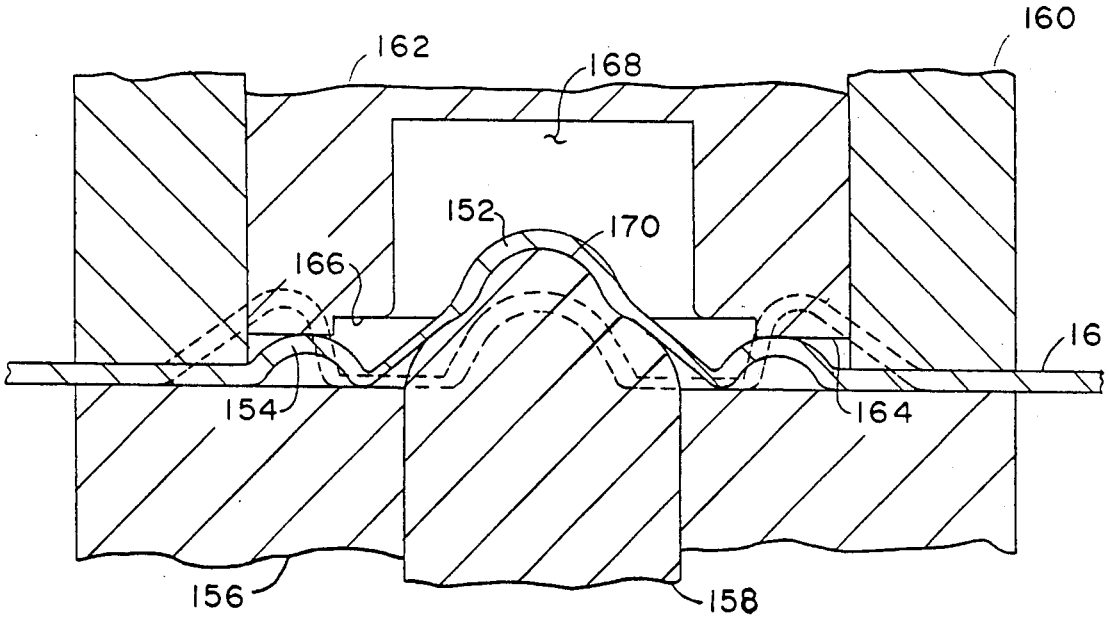

FIG. 7 is a cross-sectional view of the can end portion and the forming dies shown in FIG. 6 at a later intermediate point of the second forming step to make a partially formed rivet.

Figure 8:
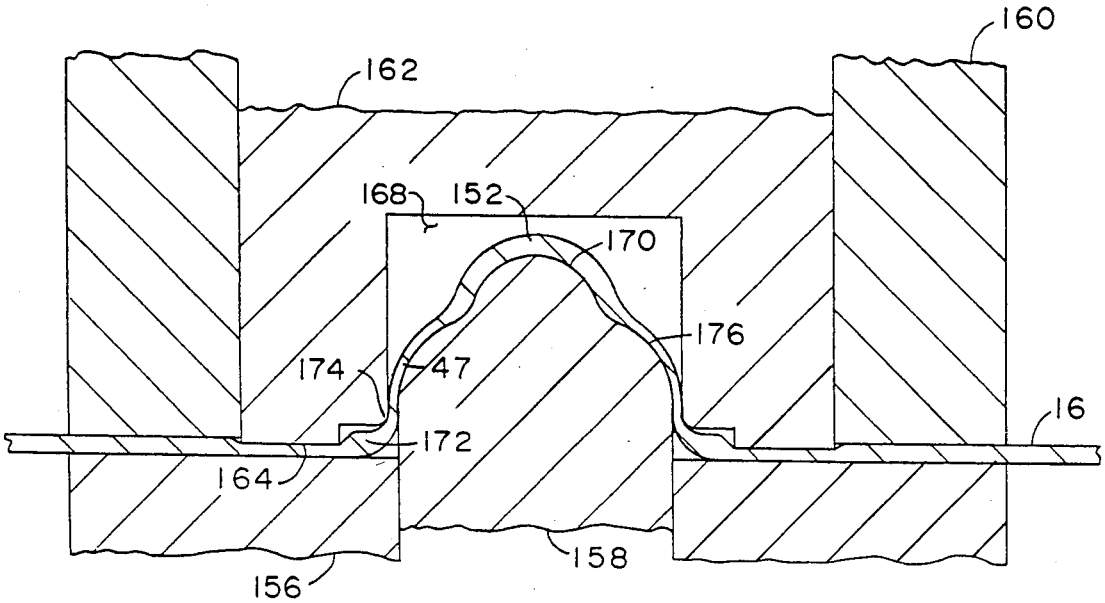

FIG. 8 is a cross-sectional view of the can end portion and forming dies shown in FIG. 7 at the completion of the second step whereby a portion of the annular ridge has been coined to extrude metal inwardly.

Figure 9:
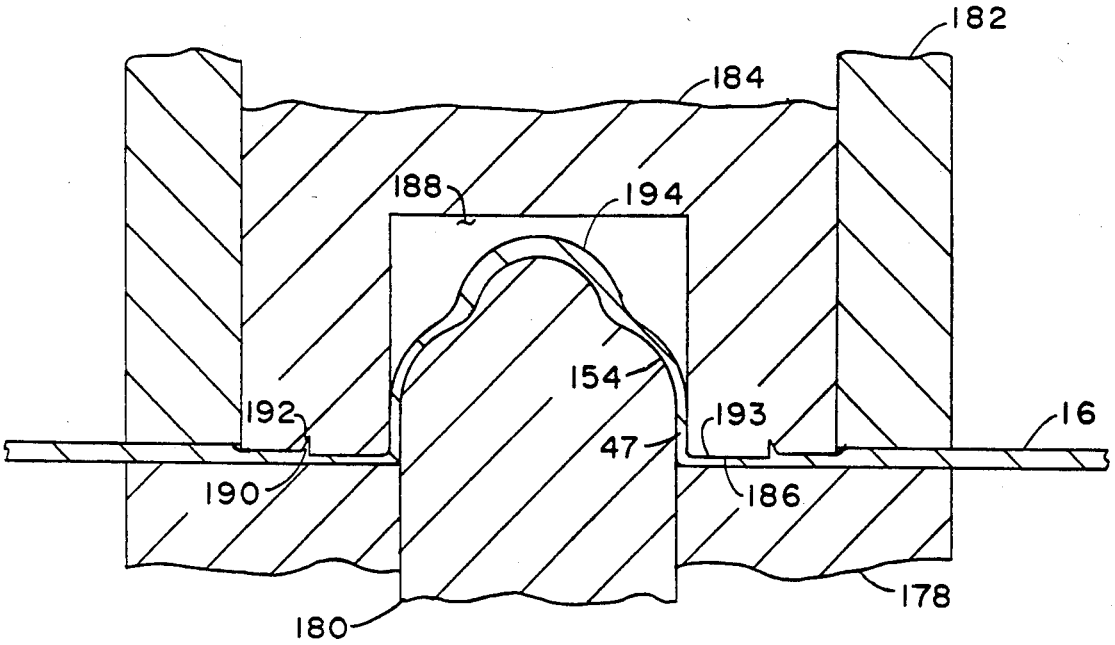

FIG. 9 is a cross-sectional view of the partially formed rivet shown in FIG. 8 and the tooling employed in the third coining step at the completion of such third step showing a rivet of this invention prior to staking to form the head.

Figure 10:
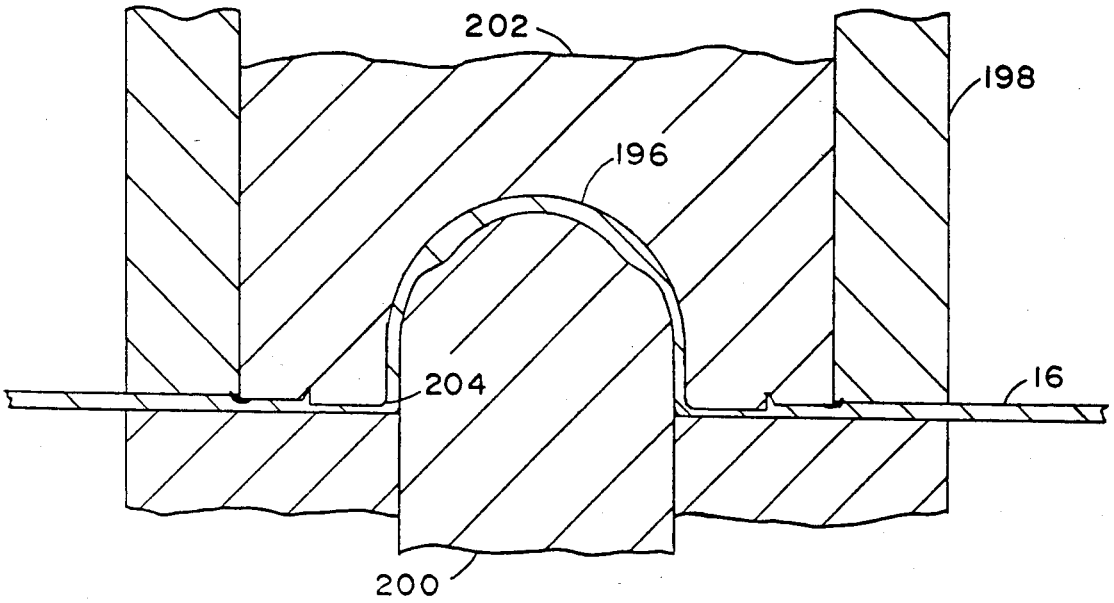

FIG. 10 is a cross-sectional view of the rivet shown in FIG. 9 and tooling at the completion of a step to reform the end wall to a substantially uniform dome.

Figure 11:
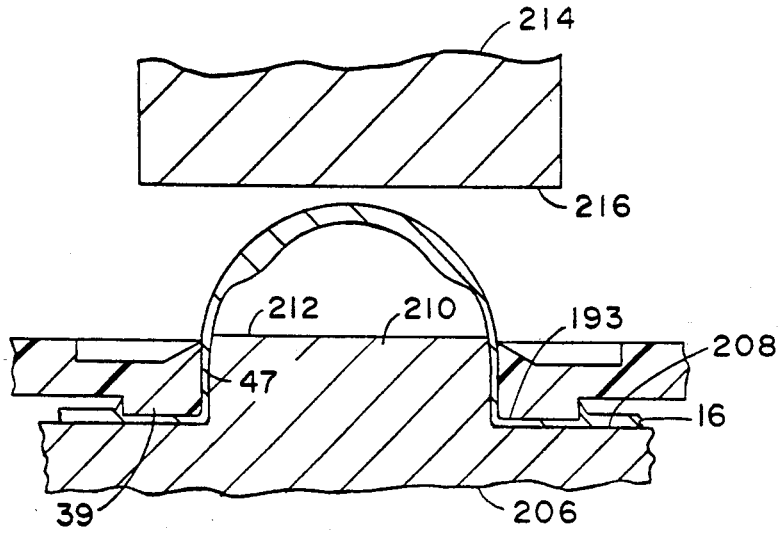

FIG. 11 is a cross-sectional view of the rivet shown in FIG. 10 and a portion of a cap to be attached to a can end in assembly with the rivet and with the assembly positioned on the tooling used to stake the rivet and form the head.

Figure 12:
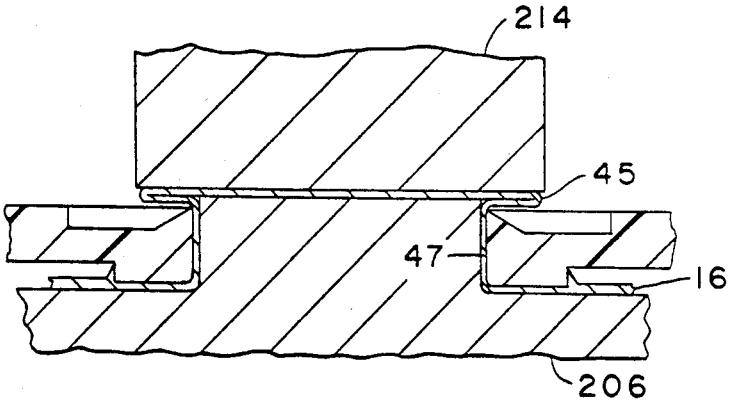

FIG. 12 is a cross-sectional view of the rivet and tooling shown in FIG. 11 at the completion of staking the rivet to form the head.

Figure 13:
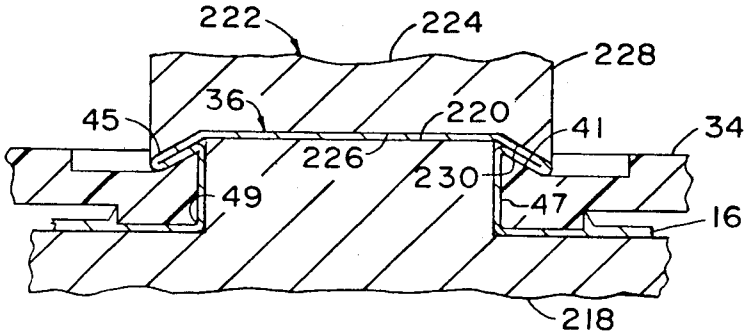

FIG. 13 is a cross-sectional view of the rivet and tooling shown in FIG. 12 at the completion of forming the rivet flange downward to interlock with the cap.

DESCRIPTION OF PREFERRED EMBODIMENTS OF THE INVENTION

A description of a preferred embodiment of a method of this invention will be made with respect to forming an integral rivet in a can end for attaching a sealing cap thereto. It is to be understood that this invention for forming a rivet is not limited to any particular use.

Figure 1:
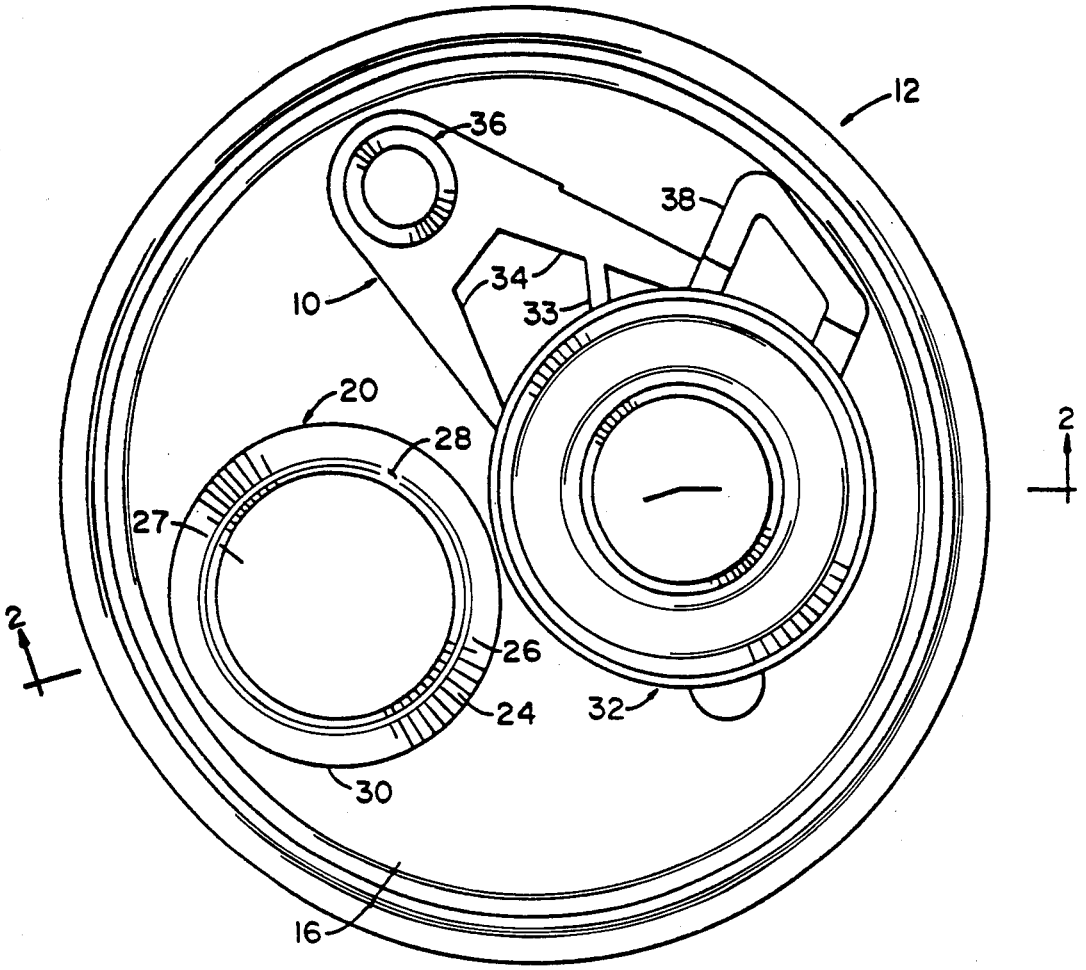
Figure 2:
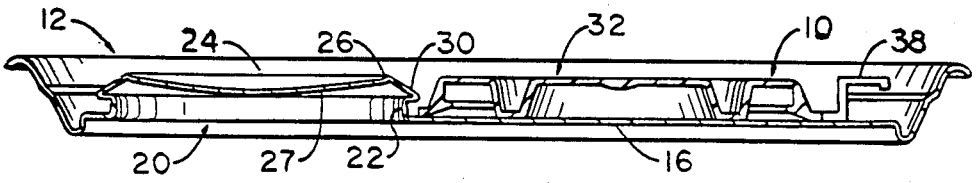
FIG. 2 is a sectional view along section line 2—2 of the can end and cap shown in FIG. 1.

Referring to FIGS. 1 and 2, a plastic cap 10 is shown attached to a metal can end closure 12 with a rivet of this invention prior to the can end closure's engagement with a can body by double seaming.

An upwardly projecting spout 20 is provided adjacent an edge of the end wall 16. The spout 20 is shown as having a circular cross section, but it could also be oval, ellipsoidal or any other shape in cross section suitable for snap engagement of the cap. The spout 20 is an integrally formed portion of the end wall 16 and includes an upwardly projecting sidewall 22 and a top wall 24. A score line 26 in the top wall 24 interrupted by a hinge portion 28 defines an opening panel portion 27 which may be pressed inwardly into the can by fracturing the score line. The score line 26 may be continuous to permit complete separation of the panel 27 from the can end, but this is not preferred from an ecology or safety standpoint as a completely severed panel might pass through the opening and be carelessly discarded or swallowed. An annular lip 30 projects outwardly from the sidewall at the juncture of the sidewall and the top wall.

Figure 3:
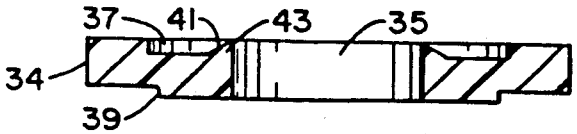
FIG. 3 is a cross-sectional view through the rivet hole portion of the cap shown in FIGS. 1 and 2.
Figure 4:
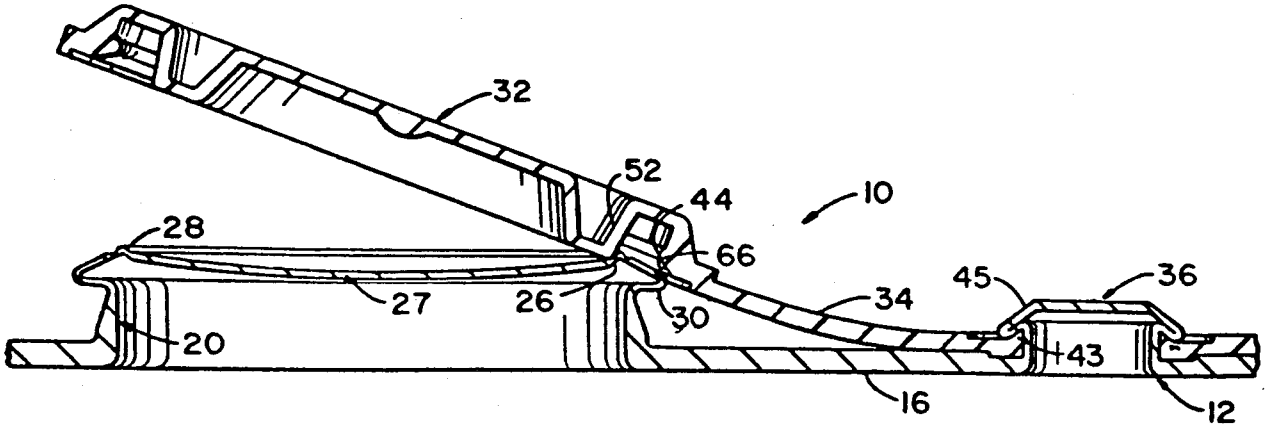
FIG. 4 is a cross-sectional view of a portion of a can end having the cap shown in FIGS. 1 and 2 attached thereto with a rivet of this invention.

The cap 10 is preferably molded in one piece using a plastic material having a low modulus of elasticity, such as low-density polyethylene, for example. The cap 10 is comprised of a seal portion 32, a pair of arms 34 angularly coverging from the seal portion 32, and a tab 38 projecting outwardly from the seal portion 32 for convenience in manipulation of the cap. A strap 33 extends angularly from the arm 34 having the tab attached thereto to the seal portion to prevent caps from tangling during handling before attachment to the can end. Alternatively to a pair of arms, a single arm of sufficient strength could also be used. The cap is pivotally attached to the end wall 16 with a rivet 36 through an opening at the junction of the arms 34. As shown in FIG. 3, the converging arms 34 have an opening 35 to accommodate the rivet 36 and an annular ledge 39 on the bottom surface adjacent the opening to seat in a recess in the can end 16. An upper surface 41 sloping downwardly from the opening 35 into an annular recess 37 provides a lip 43 for engagement with the downwardly angled rivet flange 45, as shown in FIG. 4. The rivet flange is formed downwardly a controlled amount with respect to the lip 43 when the rivet is staked to attach the cap to the can end to insure that there is engagement between the rivet and the arms 34 sufficient to maintain the seal portion 32 in a fixed position, but also permit the seal portion to be rotated by hand about the rivet with relative ease.

A rivet of this invention is formed in successive coining steps, as will now be discussed. The first coining step, shown at its completion in FIG. 5, is for the purpose of increasing the surface area of the metal in a predetermined local area of the can end to be used in forming the rivet. It can be seen that the surface area of the formed metal is substantially greater than the plan area of the metal from which it was formed. The tool elements used in this first step are a coining punch 144, a hollow, cylindrical hold-down tool 145, and a support anvil 146 having a planar surface. The punch 144 is cylindrical and adapted for longitudinal movement within the hold-down tool 145. The punch 144 has an outside diameter of 0.473 inch with an annular coining ring 148 projecting away from the punch face 150. The coining ring has an outside diameter of 0.260 inch and an inside diameter of 0.120 inch. At the beginning of the step, the punch 144 and hold-down tool 145 are spaced apart from the anvil 146 a distance sufficient to permit the portion of the can end wall 16 to be formed into a rivet to be inserted therebetween. The punch 144 and hold-down tool 145 are then advanced toward the anvil 146 with the hold-down tool adapted to contact the end wall 16 with enough force to limit the movement of metal outwardly from the coining ring without causing any reduction in the 0.0115 inch thickness of the unformed end wall. The punch 144 is advanced to impact the coining ring 148 against the end wall with sufficient force to coin the metal between the ring 148 and anvil 146 to a thickness from approximately 0.50 to 0.65 times the thickness of the end wall or, in this case, approximately 0.0065 inch. The significance of imposing a limit on the amount of coining is in consideration of the coining tooling. If the metal is thinned much below a thickness of 0.0060 inch with a typical press, the stresses generated in the coining tools will greatly shorten their life. By establishing a limit on the coined thickness as a ratio of the original thickness, therefore, a manufacturer of a rivet of this invention can extend the life of tools used to coin metal thicker or thinner than the 0.0115 inch thick metal of this preferred embodiment. Metal displaced in the coined area is extruded both outwardly and inwardly. As noted earlier, the purpose of this first step is to increase the surface area of the metal used to form the relatively long-shanked, wide-flange rivet of this preferred embodiment. It is an important feature of this invention that metal is extruded both inwardly and outwardly from the coined area. By so doing, an optimal amount of rivet surface area can be developed locally from a can end surface in a single coining step. It is also noted that the coining ring 148 projects outwardly from the punch face 150 a distance sufficient to let the interior metal freely bulge into a bubble shape 152 and the exterior metal to buckle into an annular ridge 154. This enables the extruded metal to be gathered and added to the initial panel metal in those areas without substantially increasing the thickness. If the metal were not given the space needed to freely buckle and form, the extruded metal would increase the thickness of the end metal adjacent the interior and exterior of the coining ring 148 and reduce the metal area available to form the rivet. It is also noted that even though metal is extruded outwardly, its availability for forming the rivet is not lost; it is coined inwardly and recaptured for use in the rivet in a later coining step.

In the next step, shown in FIGS. 6, 7 and 8, the formed portion shown in FIG. 5 is first reformed and then a portion of the exterior ridge 154 is coined inwardly. Referring first to FIG. 6, the tool elements used in this step are a support anvil 156 having a movable spring-loaded pin 158 protruding therethrough, a hollow cylindrical spring-loaded holddown tool 160, and a coining punch 162. The pin 158 has a 0.174 inch diameter; the hold-down tool 160 has a 0.613 inch outside diameter and a 0.390 inch inside diameter; and the coining punch has an outside diameter slightly less than 0.390 inch so that it slidably fits within the hold-down tool 160. The punch 162 has a coining face 164 extending inwardly from the periphery. The inside diameter of the coining face is 0.265 inch. A ledge 166 is set back from the punch face a sufficient distance to accommodate a quantity of extruded metal, as will be noted later, and the inside diameter of the ledge is 0.200 inch. A central cavity 168 in the punch is deep enough to accommodate a reformed central portion of the can end, as will be shown later. FIG. 6 shows the portion formed in FIG. 5 in two stages of being reformed, with the first stage to the left of the centerline and the second stage to the right thereof. In the first stage, the tooling is shown in position at the beginning of this reforming step. In this position, the coining face 164 is recessed from the face of the hold-down tool a distance equal at least to the height of the ridge 154. The bubble 152 in the can end is supported on the nose 170 of the pin 158, and the corner of the hold-down tool 160 contacts a portion of the ridge 154. The pin 158 is in a fully extended position. From this position, the punch 162 and hold-down tool 160 are mixed together until the can end 16 contacts the anvil 156, as shown in the second stage position to the right of the centerline. At the completion of the third stage, as shown in FIG. 7, the punch 162 and hold-down tool 160 have moved downwardly and the bubble 152 acting against the nose 170 on the pin 158 has forced it downward and compressed the spring. It may be seen that in this intermediate tool position, before any second step coining has occurred, the formed end piece has been partially reformed. The extent of the reforming is shown by comparing the partially reformed piece with the formed piece in FIG. 5 which is shown in dashed lines. The hold-down spring is relatively strong and capable of forcing the hold-down tool 160 to impose a load against the end wall close to the yield point of the metal. This is to insure that when the coining punch 162 is driven further downward in the fourth stage, as shown in FIG. 8, metal extruded from the coined area is prevented from moving outwardly. Referring now to FIG. 8, the punch 162 has been advanced to its maximum extent with the coining face 164 reducing the metal between it and the anvil 156 to a thickness of from approximately 0.52 to 0.68 times the thickness of the can end wall or, in this case, approximately 0.0068 inch. The ratio of the coined thickness to the original thickness is different than that of the first coined metal because a larger area of metal is coined in this step. In this step, the limiting thickness of coined metal is 0.0065 inch, therefore, and the thickness ratio limitation is slightly greater. As the punch 162 moves downward from the position shown in FIG. 7, flattening of the ridge 154 reduces the force acting against the nose pin 158 and the compressed spring begins to stretch the bubble 152 upward. Metal displaced by the coining extrudes inwardly to provide additional metal area to increase the bubble height and to form the thickened portion 172 having a thickness of approximately 0.0141 inch. Stated as a function of the thickness of the can end wall, this thickness may be from 1.14 to 1.31 times the thickness thereof. The reason that the extruded metal substantially thickens the end panel in the space below the ledge 166 is because of the frictional resistance against upward movement created by the metal moving around the ledge corner 174 into the relatively narrow gap between the punch 162 and the nose pin 158 as the pin extends the bubble 152 upward. It is noted that during this step the rivet shank is partially formed.

The final coining step before the rivet is staked to form the flange and fasten the cap to the can end is shown in FIG. 9 with the position of the tool elements shown at the completion of the step. The tool elements in this final tool assembly are a support anvil 178 having a cylindrical pin 180 protruding therethrough, a hollow cylindrical hold-down tool 182, and a cylindrical coining punch 184. The cylindrical pin 180 has a 0.174 inch diameter and the hold-down tool 182 has a 0.390 inch inside diameter. The punch 184 has a coining face 186 with a 0.200 inch inside diameter and a central cavity 188 extending into the punch a distance sufficient to accommodate the rivet as formed prior to staking. The coining punch 184 has an outside diameter slightly less than 0.390 inch to enable it to slide within the hold-down tool 182. At the beginning of this step, the punch 184 and hold-down tool 182 are spaced apart from the anvil 178 a distance sufficient to enable positioning the reformed piece, as shown in FIG. 8, on the pin 180. The punch 184 is positioned within the hold-down tool 182 so that the coining face 186 does not extend outward beyond the end of the hold-down tool 182. After positioning the reformed piece on the pin 180, the punch 184 and hold-down tool 182 are advanced toward the anvil 178. The hold-down tool 182 is spring loaded with a force sufficient to hold the end 16 against the anvil 178 with stresses in the contact area approximately equal to the yield strength of the end, thereby minimizing extrusion of metal outwardly from the punch 184. With the end held firmly in place, the punch 184 is advanced to the position shown in FIG. 9. Included in the coining face 186 is a small inwardly extending annular groove 190 to form an annular ridge 192 in the end wall for the purpose of providing a recess 193 in the end wall to accommodate a ledge on the cap, as will be seen later. The coining face interior of the groove 190 projects outwardly 0.0008 inch beyond the face exterior of the groove. Thus, with advancement of the punch 184, the portion of the punch interior of the groove 190 strikes the thickened end portion 172, as may be seen in FIG. 8, and begins compressing it. Metal is extruded inwardly and the height of the partially formed rivet increases as the pin 180 acts against the end wall 194 of the partially formed rivet. A small amount of metal is extruded outwardly to fill the groove 190 and form the ridge 192. At the completion of the stroke, the end wall interior of the groove is coined to a thickness from approximately 0.44 to 0.57 times the thickness of the can end wall or, in this case, approximately 0.0060 inch. Because of the difference in the shape and the area of the metal coined in this step, the limitations on thickness expressed as a ratio of the original thickness are different from those in the prior coining step. In this step, the metal may be coined to a thickness as little as 0.0057 inch with a concomitant reduction in the thickness ratio limitation. The metal displaced by flattening the thickened portion 172 and coining forms the ridge 192 and extends the height of the rivet shank 47 to its finished length. As reformed and shown in FIG. 9, the end wall 194 of the rivet before staking has approximately the same thickness "t" as the can end 16; the shank 47 has a thickness of approximately 0.50 to 0.65t; the coined portion inward of the ridge 192 has a thickness of approximately 0.44 to 0.57t; and the coined portion outward of the ridge 192 has a thickness of approximately 0.52 to 0.68t.

As has been noted heretofore, a rivet made by a method of this invention has a relatively long shank. In this preferred embodiment, for example, the shank is approximately 0.030 inch long which is twice as long as the shank of a rivet used to attach a typical metal tab to a can end.

The rivet as formed and shown in FIG. 9 can be formed into the rivet 36 shown in FIG. 4. It is preferred, however, to reform the rivet so as to have a substantially uniform dome 196, as shown in FIG. 10, prior to staking the rivet. The dome is formed by restraining the end wall 16 against movement with hold-down tooling 198 while a mandrel 200 forces the shape shown in FIG. 9 upwardly into the cavity in a female die 202. To facilitate reforming the end wall into a dome 196, the interior corner 204 of the female die 202 is radiused to prevent tearing during reforming.

Rivet 36 is formed by a step referred to as staking. An assembly of the rivet and cap is positioned in the staking tooling as shown in FIG. 11. It may be seen that the cap ledge 39 fits in the can end recess 193 and provides an engagement which contributes to preventing detachment of the cap after the rivet is staked and fully formed. The lower die 206 has a planar support surface 208 to support the can end wall 16 and a cylindrical portion 210 having an upper planar surface 212 which fits within the rivet shank 47. An upper cylindrical die 214 having a planar end surface 216 is positioned coaxially with the lower cylinder portion 210.

To stake the rivet, upper die 214 is moved downwardly whereby the dome portion between dies 214 and 206 is first flattened and then coined, as shown in FIG. 12. Metal displaced by the coining extrudes radially outwardly forming the rivet flange 45, as shown in FIG. 12. The final step of attaching the cap to the can end 16 is shown in FIG. 13. This die set includes a support tool 218 having an upwardly projecting cylindrical portion 220 sized to fit within the shank 47 of the staked rivet shown in FIG. 11, and a flanging tool 222 above the staked rivet in coaxial alignment with the cylindrical portion 220. The flanging tool 222 is cylindrical having a central portion 224 with a planar surface 226 having a diameter approximately the same as the outside diameter of the rivet shank 47. Extending outwardly from the central portion 224 is a flange forming portion 228 which has a surface 230 sloping angularly downwardly from the central surface 226. At the beginning of this final step, the support 218 and flange forming tool 222 are spaced apart and the staked rivet shown in FIG. 12 is positioned on the upwardly projecting portion 220. The forming tool 222 is then moved downward, and as the flange forming portion 228 contacts the flange, it is bent downward at an angle as shown in FIG. 13. The downward movement of die 222 is controlled to insure that the cap arms 34 are not engaged with the rivet 36 so tightly that rotation of the cap about the rivet is restricted.

There is a substantial and important difference between the outward extent of the flange 45 in FIG. 12 and that of a rivet used to attach a metal tab to an easyopen can end. Typically, the flange of a rivet used to attach a tab to a can extends outwardly from the rivet shank approximately 0.012 inch and in cross section has a bulb-like shape; that is, the bottom surface of the flange extending outwardly from the shank is outwardly convex rather than being substantially planar and extending outwardly from the shank at approximately a 90° angle as shown in FIG. 12. Furthermore, since the tab is metal and there is generally no requirement or desirability that the tab rotate, the rivet shank diameter is increased during staking and the head is formed tightly against the tab. In essence, the tab functions as a fixture or anvil against which the rivet is formed and the tab is held in place by expanding the rivet shank in the tab hole as well as the flange overlying the tab.

In contrast, a rivet of this preferred embodiment is capable of being staked without any appreciable expansion of the shank in order that the plastic cap can be rotated. It is necessary, therefore, that the rivet flange provide all the power to engage the cap. The engaging power is provided in two ways. First, the outward extent of the flange 45 from the shank 47 after coining as shown in FIG. 12 is approximately 0.025 inch or double that of a typical tab engaging rivet. It is apparent that the optimal outward extent of the flange that can be generated depends upon the amount of material in the end of the rivet before staking. Thus, the 0.025 inch outward extent noted with respect to this preferred embodiment would be lesser or greater if the rivet were smaller or larger. The outward extent of the flange of a rivet within the scope of this invention can be expressed as 0.11 to 0.15 times the diameter of the rivet shank. Second, to further insure that the cap cannot be pried free of the rivet, the cap has an upwardly extending lip 41 adjacent the rivet opening 35 and the rivet is adapted so that the flange 45 can be formed downward at an angle as shown in FIG. 13. The cap, therefore, becomes interlocked with the rivet to prevent its disengagement therefrom even though the cap can be freely rotated about the rivet. In conjunction with interlocking the cap with the rivet flange, as shown in FIG. 13, the invention includes another feature which is advantageous in giving assurance of the security of the attachment of the cap to the can end. It may be seen that in order to disengage the cap from the rivet, the cap portion which is locked in the space underlying the flange 45 must be squeezed and stretched through the gap or orifice defined by the can end wall and the outward end of the flange 45. Thus, the greater the mass or volume of plastic material underlying the flange having a thickness or vertical dimension greater than the gap or orifice, the more difficult it is to disengage the cap. In this preferred embodiment, such mass or volume of material is maximized by making the inside corner 49 between the shank 47 of the rivet and the can end wall as sharp as possible. The corner 49 can be made sharp because it is formed in the coining step shown in FIG. 9. During coining, most of the metal extrusion occurs in the central portion of the metal thickness which facilitates the extruded metal flowing around the sharp corner on the inside diameter of the coining face 186. It is apparent that the larger the radius on the inside corner 49 between the shank 47 and the can end 16, the easier it would be to stretch the cap and disengage it from the rivet. In this preferred embodiment, the inside corner radius 49 is 0.0065 inch. Tyically, to maximize retention of the cap, a rivet of this invention should have an inside corner 49 radius of 0.43 to 0.65 times the thickness of the can end 16. It is notable that the rivet is formed into its final shape as shown in FIG. 13 completely independent of the cap. That is, the cap does not serve as a fixture or anvil in any way to assist in forming the flanged head.

While the invention has been described in terms of preferred embodiments, the claims appended hereto are intended to encompass all embodiments which fall within the spirit of the invention.

What is claimed is:

1. A method of forming an integral rivet in a sheet metal panel, comprising the sequential steps of:

coining a first annular portion of a metal panel to extrude a portion of metal inwardly and form an upstanding bubble;

coining a second portion circumscribing the first portion to extrude additional metal inwardly and form a partial rivet having a larger area in plan than the area in plan of the bubble;

coining a third portion circumscribing the partial rivet to extrude additional metal inwardly which increases the height of the partial rivet and forms the integral rivet.

2. A method of forming an integral rivet as claimed in claim 1 whereby the step of coining the first portion includes extruding a portion of metal outwardly in addition to extruding a portion of metal inwardly and forming an annular upstanding ridge outwardly adjacent the coined area.

3. A method of forming an integral rivet as claimed in claim 2 whereby the step of coining a second portion includes coining at least a portion of the annular ridge and forming a thickened wall portion circumscribing the partial rivet.

4. A method of forming an integral rivet as claimed in claim 3 whereby the step of coining a third portion includes coining the thickened wall portion.

5. A method of forming an integral rivet as claimed in claim 1 which further includes, following the step of coining a third portion, a step of forming a substantially uniform dome-shaped end wall on the rivet.

6. A method of forming an integral rivet as claimed in claim 1 whereby in the step of coining a first annular portion, such portion is reduced in thickness to a thickness from 0.50 to 0.65 times the thickness of the metal panel.

7. A method of forming an integral rivet as claimed in claim 1 whereby in the step of coining a second portion, such portion is reduced in thickness to a thickness from 0.52 to 0.68 times the thickness of the metal panel.

8. A method of forming an integral rivet as claimed in claim 3 whereby in the step of forming the thickened wall portion, such wall portion is formed with a thickness of 1.14 to 1.31 times the thickness of the metal panel.

9. A method of forming an integral rivet as claimed in claim 1 whereby in the step of coining a third portion, such portion is reduced in thickness from a thickness of 0.44 to 0.57 times the thickness of the metal panel.

10. A method of forming an integral rivet in a sheet metal panel, comprising:

coining an annular portion of a metal panel to extrude metal inwardly and outwardly to form a bubble and an annular ridge therearound in the panel;

coining a portion of the metal panel circumscribing said bubble;

reforming the bubble into a rivet having a larger area in plan than the area in plan of the bubble; and coining a portion of the metal panel circumscribing said rivet to extrude metal inwardly to increase the height of the rivet.

11. A method as set forth in claim 10 whereby the step of coining the metal panel circumscribing the upstanding bubble includes coining at least a portion of the annular ridge

* * * * *